United States Patent [19]

Fisher et al.

[11] Patent Number: 4,933,526

[45] Date of Patent: Jun. 12, 1990

[54] SHAPED MICROWAVEABLE FOOD PACKAGE

[75] Inventors: John R. Fisher, Hockessin; Edward J. Kaliski, Greenville, both of Del.

[73] Assignee: E. I. Du Pont de Nemours and Company, Wilmington, Del.

[21] Appl. No.: 278,475

[22] Filed: Dec. 1, 1988

[51] Int. Cl.[5] ..... H05B 6/80

[52] U.S. Cl. ..... 219/10.55 M; 219/10.55 E; 426/107; 426/234; 426/243; 99/372; 99/DIG. 14

[58] Field of Search ..... 219/10.55 R, 10.55 A, 219/10.55 E, 10.55 F, 10.55 M; 99/451, DIG. 14, 353, 372, 367, 378; 426/107, 113, 241, 243, 234

[56] References Cited

U.S. PATENT DOCUMENTS

| | | | |
|---|---|---|---|
| 3,795,183 | 3/1974 | Roth et al. | 219/10.55 A X |
| 3,943,320 | 3/1976 | Bowen | 99/DIG. 14 |
| 4,230,924 | 10/1980 | Brastad | 219/10.55 E |
| 4,267,420 | 5/1981 | Brastad | 219/10.55 F |
| 4,398,077 | 8/1983 | Freedman et al. | 219/10.55 E |
| 4,518,651 | 5/1985 | Wolfe | 428/308.8 |
| 4,641,005 | 2/1987 | Seiferth | 219/10.55 E |
| 4,748,308 | 5/1988 | Drews | 219/10.55 E |
| 4,775,771 | 10/1988 | Pawlowski et al. | 219/10.55 E |
| 4,794,005 | 12/1988 | Swiontek | 426/107 |
| 4,820,893 | 4/1989 | Mode | 219/10.55 E |
| 4,833,007 | 5/1989 | Huang | 428/242 |
| 4,851,632 | 7/1989 | Kaliski | 219/10.55 E |

*Primary Examiner*—Philip H. Leung

[57] ABSTRACT

The present invention provides a package suitable for microwave cooking and browning of food items, comprising a microwave susceptive mold containing at least one cavity for containing food items, and a microwave susceptive cover extending over and closing the cavities.

11 Claims, 1 Drawing Sheet

SHAPED MICROWAVEABLE FOOD PACKAGE

BACKGROUND OF THE INVENTION

This invention relates to packaging materials suitable for heating food items in a microwave oven. In particular it relates to materials and processes for preparation of food items characterized by varying configurations and requiring surface browning and crisping.

Many food products are difficult to prepare in a microwave oven, particularly those that require surface browning and crisping. In order to provide such browning and crisping, the use of packaging materials containing microwave susceptors has become popular. Such susceptors absorb microwave energy and as a result generate heat. Under favorable conditions the susceptors transfer sufficient heat to the adjacent food surfaces to create a browning and crisping effect.

U.S. Pat. No. 4,641,005, Seiferth, discloses a disposable food receptacle for use in microwave cooking, which includes a provision to brown the exterior of the food in the receptacle. A thin layer of an electrically conductive material is incorporated into the receptacle on the food contacting surfaces thereof, so that the conductive layer will become heated by the microwave radiation and will, in turn, brown the exterior of the food in the receptacle. The receptacle includes a smooth surfaced plastic film, as a protective layer, and a support means formed of paper stock material.

U.S. Pat. No. 4,230,924, Brastad, discloses a food package including a flexible wrapping sheet of dielectric material capable of conforming to at least a portion of the article of food's shape. The dielectric wrapping sheet has a flexible metallic coating thereon, the coating being subdivided into a number of individual metallic islands or pads separated by criss-crossing non-metallic gaps.

U.S. Pat. No. 4,267,420, Brastad, discloses a food item wrapped with plastic film having a very thin coating thereon. The film conforms to a substantial portion of the food item. The coating converts some of the microwave energy into heat which is transmitted directly to the surface portion of the food so that a browning and/or crispening is achieved.

U.S. Pat. No. 4,518,651, Wolfe, discloses a flexible composite material which exhibits a controlled absorption of microwave energy based on presence of particulate carbon in a polymeric matrix bound to a porous substrate. The coating is pressed into the porous substrate using specified temperatures, pressures, and times, resulting in improved heating.

Copending U.S. application No. 002,980 describes a conformable wrap for microwave cooking, comprising a dielectric substrate substantially transparent to microwave radiation and a coating on at least one surface of the substrate comprising about 5 to 80% by weight of metal or metal alloy susceptor in flake form, and about 95 to 20% by weight of a thermoplastic dielectric matrix. An aluminum flake of selected geometry is preferred.

Copending U.S. application No. 037,988, now U.S. Pat. No. 4,833,007 discloses a flexible wrap with a susceptor material which couples to both the electrical and magnetic components of the microwave field. One such film comprises stainless steel sputtered onto polyethylene terephthalate film.

Copending U.S. application No. 188,556 discloses a conformable laminated wrap for packaging articles of food requiring browning and crispening and a degree of shielding during microwave cooking. The laminated wrap has at least two layers of heat resistant microwave transparent plastic film, and at least one substantially continuous layer of microwave susceptive material, which is coated on at least one of the interior surfaces or interfaces formed between the plastic films of the laminate.

It is also known in the art to simulate a natural product by forming a food precursor in a mold to achieve a final product of appropriate texture and appearance. For example, uniform reconstituted potato chips are sold commercially, nested and packed in a compact container. It is believed that for formation of such potato chips, a dehydrated potato powder is hydrated and conventionally baked in molds to produce browned and crisped chips of uniform size.

SUMMARY OF THE INVENTION

The present invention provides a package suitable for microwave cooking and browning of a finished food item prepared from a formable, brownable food precursor, comprising:

(a) a microwave susceptive mold comprising at least one cavity of a suitable size and shape for the finished food item, said mold having sufficient microwave activity to generate sufficient heat in a microwave oven to brown a brownable food precursor placed adjacent thereto; and (b) a cover extending over and closing the cavity, said cover being provided with a microwave susceptor layer having sufficient microwave activity to generate sufficient heat in a microwave oven to cook and brown a brownable food precursor placed adjacent thereto.

The present invention also provides a process for microwave cooking and browning of a food item prepared from a formable, brownable food precursor, said process comprising:

(a) preparing the formable, brownable food precursor;

(b) placing the food precursor into a cavity in a mold, said mold being microwave susceptive and having sufficient microwave activity to generate sufficient heat in a microwave oven to cook and brown a brownable food precursor placed adjacent thereto;

(c) conforming the food precursor to the contours of the cavity of the mold;

(d) providing a cover for the mold, said cover having sufficient microwave activity to generate sufficient heat and brown a brownable food precursor placed adjacent thereto; and (e) cooking the food precursor in a microwave oven for a time sufficient to cook the food precursor and to brown its surface.

DETAILED DESCRIPTION OF THE INVENTION

Figure 1:
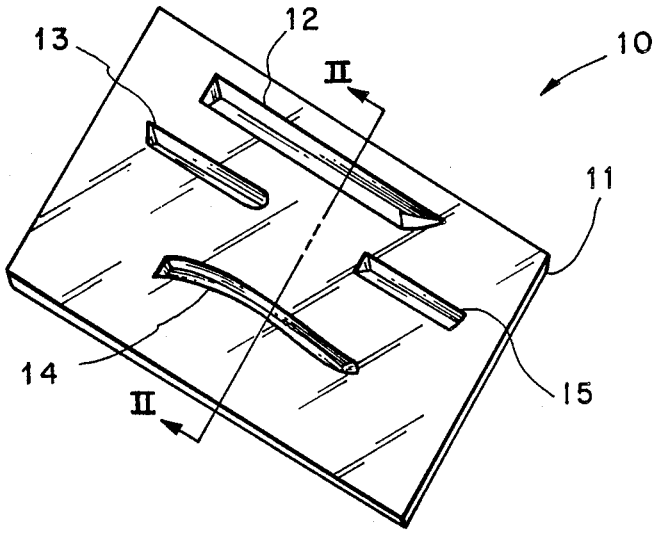
FIG. 1 a perspective drawing of one embodiment of the package of the present invention.

Referring to FIG. 1, package 10 comprises a mold or tray 11 with at least one and preferably a plurality of mold cavities, 12, 13, 14, and 15. The number of cavities of course will vary depending on the application; typically sufficient cavities will be present to contain a customary portion of food items to be contained therein, as described below. The cavities may all be similar, but preferably will vary in geometry to simulate the normal variations and distribution encountered in a naturally occurring finished food items. The cavities illustrated in FIG. 1 simulate french fried potatoes. Cavity 12 is of medium length, straight, of rectangular cross section, and has one tapered end. Cavity 13 is short, straight, of triangular cross section, and has one truncated end. Cavity 14 is long, triangular in cross section, and slightly curved. Cavity 15 is about the same as cavity 13.

Figure 2:
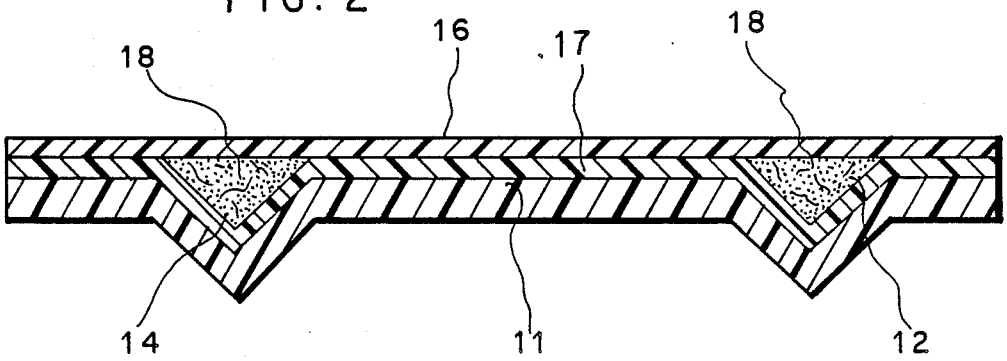
FIG. 2 is a cross-sectional elevation taken on line II—II of FIG. 1.

A susceptor material lines at least the cavities of tray 1. In the illustration a susceptor film, 17, is laminated to the tray, as seen in FIG. 2. Thus the sides of the formable, brownable food precursor, 18, when pressed into the cavities, come into close contact with the susceptor along the sides of the cavities. Thus the sides of the food precursor can be browned and crisped in a microwave oven by the action of the susceptor. A microwave active cover, such as film 16, is placed across the top of the tray and contacts the top of the food precursor, so that the top may also be browned and crisped in a microwave oven.

The mold or tray may be formed of any material suitable for use in a microwave oven. Examples of suitable materials include, paperboard, glass, and many types of plastic, including crystallized polyethylene terephthalate (CPET), aliphatic crystalline grades of nylon, thermosetting polyester, polypropylene, polycarbanate, polyetherimide, and high impact polystyrene. The tray may also be made of laminated structures, for example, an engineering polymer such as polypropylene, polycarbonate, or polyetherimide laminated with ethylene vinyl alcohol copolymer, polyamide, or polyvinylidiene chloride. Polymeric compositions containing various fillers or reinforcing agents such as glass, mica, talc, calcium carbonate, or clay may also be used, as can blends of cerrain of the above materials.

The mold or tray has on its surface or contained within its structure a microwave susceptive material, extending over at least those areas which comprise the cavities in which the food precursor is pressed. It is preferred that the body of the tray itself is transparent to microwave radiation, and the susceptor material is applied to the surface, preferably carried on a film which is laminated to the mold.

The film which is preferably used to carry the microwave susceptor material is a heat resistant, microwave transparent plastic film. This film may be made from any suitable plastic film which has the desired properties of heat resistance and microwave transparency. The term "heat resistant" refers to the ability of the film to withstand the temperatures generated in a 700 watt microwave oven during cooking without melting or degrading when in contact with a food item. When the film is made into the package of the present invention, temperatures of up to about 220° C. or more may be encountered under microwave cooking conditions, so the film should maintain its integrity at such temperatures. Certain polyesters, such as polyethylene terephthalate (PET), having a melting point of about 260° C., are particularly suitable for this purpose. Other suitable materials may include certain types of polyesters, polyamides, cellophane, cellulose triacetate, ethylene chlorotrifluoroethylene copolymers, fluorinated polyethylene, polyimides, polysulfones, polyvinyl alcohol polymers, polyetheretherketones, polytetrafluoroethylene, and others.

The heat resistant film is provided with a microwave susceptive material in the form of a coating or layer which extends over at least a portion of its surface area. The coating may be of any material suitable for conversion of at least a portion of incident microwave radiation to heat. For example, the susceptive material can be in the form of a coating of (i) about 5 to 80% by weight of metal or metal alloy susceptor in flake form, embedded in (ii) about 95 to 20% by weight of a thermoplastic dielectric material. More preferably the relative amount of such susceptor will be about 25 to 80% by weight, and most preferably about 30 to 60% by weight. A coating thicknesses of about 0.01 mm to about 0.25 mm (about 0.4 to 10 mils) is suitable for many applications. The surface weight of such a susceptor coating on the substrate is from about 2.5 to 100 $g/m^2$, preferably about 10 to about 85 $g/m^2$.

Suitable thermoplastic dielectric materials in which the susceptor flake may be embedded include, but are not limited to, polyesters selected from the group consisting of copolymers of ethylene glycol, terephthalic acid, and azelaic acid; copolymers of ethylene glycol, terephthalic acid, and isophthalic acid; and mixtures of these copolymers.

Suitable susceptor flake materials for use in this embodiment of the invention include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10,and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 1:2. Alternatively, the flakes, if not circular, can be applied to the film in two or more separate passes, which also provides an improvement in the degree of uniformity of heating. Films prepared from such material will typically have a surface resistance of at least $1\times10^6$ ohms per square, and are normally optically opaque. Such films are described in more detail in copending U.S. patent application No. 002,980, filed Jan. 20, 1987, the disclosure of which is incorporated herein by reference.

Alternatively, the base film can be coated with a thin layer of susceptor material by vacuum deposition techniques. In this embodiment, the susceptor material can be a substantially continuous electrically conductive material which is present in sufficient thickness to cause the multilayer structure to heat under microwave cooking conditions to a temperature suitable for browning or crispening of food placed adjacent thereto, but not so thick as to completely prevent penetration of microwave energy to the interior of the food. A preferred susceptor material is vacuum metallized aluminum, which will preferably be present in sufficient amounts to impart an optical density of about 0.10 to about 0.35, preferably 0.16 to about 0.22, to the film. Other metals, of course, may be used, including gold, silver, mu-metal, stainless steel, nickel, antimony, copper, molybdenum, bronze, iron, tin, and zinc. Methods other than vacuum deposition may also be used if they provide a substantially continuous layer of the desired thickness.

The amount of susceptor material applied to the film, whether metal flake, continuous metallized layer, or other material, may be varied within certain limits which will be apparent to one skilled in the art. The test to determine the correct amount of material is whether the coating will heat to the proper temperature and provide sufficient heat flux for browning or crispening of food items. The required temperature may depend on the particular food item used but for many applications is at least about 180° C.

It is preferred that the film of the present invention be a laminate comprising at least one layer of heat stable resin in addition to the layer of resin on which the susceptor materials is located. Such laminates are more fully described in copending U.S. patent application No. 188,556, filed Apr. 29, 1988, the disclosure of which is incorporated herein by reference. The presence of such a heat stable resin layer in a laminated structure provides a limited, controlled amount of shrinkage to the film. Particularly preferred for this layer is heat stabilized polyethylene terephthalate. Heat stabilized PET is made from a regular grade of PET film by a stabilization process involving a series of heat treatment and relaxation steps, and is well known to those skilled in the art. A heat stabilization process for PET is more fully described in Bulletin E-50542, "Thermal Stabilization of Mylar®," from E. I. Du Pont de Nemours and Company. Heat stable films, of course, may include films other than heat stabilized PET, including those listed above, provided such films have the desirable property of minimal shrinkage under microwave cooking conditions.

The microwave susceptive film may also contain a layer or a partial surface layer of a relatively low melting thermoplastic material, suitable for sealing the film to the mold or to the cover of the package. Suitable materials include polyesters selected from the group consisting of copolymers of ethylene glycol, terephthalic acid, and azelaic acid; copolymers of ethylene glycol, terephthalic acid, and isophthalic acid; and mixtures of these copolymers.

Across the top of the cavities of the mold is affixed a cover, provided with a suitable microwave susceptive means. It is preferred that the cover be one of the types of film described above. The cover may be adhered or laminated to the mold by use of the optional layer of relatively low melting thermoplastic material, described above, or by other adhesive or mechanical means. It may be desirable to provide one or more holes in the cover to permit venting of steam formed during the cooking process.

In practice, a food product precursor is pressed into the cavities of the mold. (It may be desirable to apply a light, edible lubricant such as vegetable oil to the surfaces of the mold and the cover, in order to aid in removal of the finished food item.) The cover susceptor film is affixed to the top, and the entire package is optionally frozen. The consumer places the package in a microwave oven and cooks it for an appropriate length of time. The microwave energy that penetrates the films cooks the food precursor. The energy that is absorbed by the mold and the cover film heats these surfaces and browns and crisps the contacted surfaces of the food precursor. After suitable time the package is removed from the oven, and the cooked, browned, and crisp food item is removed.

EXAMPLE 1

A mold was prepared having a cavity of approximately the size and shape of a french fried potato (about 75 mm long and about 20 mm wide, having a triangular cross section.) The mold was made of cardboard, and was lined with a film of polyethylene terephthalate coated with a thin layer of aluminum flakes embedded in a low-melting polyester matrix, as described in more detail in the above-mentioned copending U.S. patent application 002,980. The film, which also included a heat sealable adhesive layer, was bonded to the cardboard mold by sealing with a hot iron. The surface of the film was coated with vegetable oil.

A potato composition was prepared from commercially available dehydrated potato powder (3 tablespoons, about 50 mL), mixed with water, skim milk (¾ cup, about 170 mL), and vegetable oil (1 teaspoon, about 5 mL). The composition was pressed into the lined mold. A lidding of film of the same type used to line the mold, its surface likewise lightly coated with vegetable oil, was placed over the top of the mold cavity and held in place by heat resistant tape based on polyimide film. Such tape is available as Scotch TM brand industrial tape 5413 "Kapton", from the 3M Company. ("Kapton" is a registered trademark of E. I. du Pont de Nemours and Company for polyimide films.) Three small holes were placed in the lid to permit venting. The package was placed in a 700 watt microwave oven and cooked for two minutes. A browned and crisp french fry or potato stick was formed.

EXAMPLE 2

A small red potato was skinned and comminuted in a food processor to form roughly 200g of a granular semi-liquid material. To this material was added about 1 to 2g (½ teaspoon) of corn starch. (Upon standing, this composition turned a dark reddish black.) A portion of this potato composition was conformed into the cavity of a mold made of cardboard lined with a laminated susceptor film. The laminated susceptor film was a laminate containing two layers of 23 micrometer (92 gauge) PET film, each coated (in four passes) with a layer of 42% aluminum flake in a matrix of low melting polyester copolymer, as described in U.S. patent application 002,980. Each coating layer had a thickness of about 32 $g/m^2$. The two layers were laminated together using Adcote TM 503-A adhesive (from Morton Thiokol) so that the layers of aluminum flake were separated by a layer of PET film. A third layer, 12 micrometer (48 gauge) PET film coated with about 51 micrometers (2 mils) of the same low melting polyester copolymer, was similarly laminated to the exposed flake side. A cover of the same laminated susceptor film was placed over the tray and sealed with polyimide-based tape. The tray was placed atop an inverted paper plate in a 700 W microwave oven and cooked for 1 minute. At the end of the minute the cover had begun to disintegrate. The package was removed from the oven, the potato composition pressed firmly into the mold, a fresh piece of cover film secured over the mold, and cooking was continued. After an additional minute of cooking, a formed potato product with structural integrity was removed from the mold.

EXAMPLE 3

A potato composition was prepared by removing the outer surfaces of several commercially available frozen french fries ("Ore-Ida" brand, from Ore-Ida Foods, Inc., Boise, ID 82706.) The inner material was crushed in a mortar. The resulting mass of potato composition was packed by pressing onto a mold, lined with a laminated susceptor film as described in more detail in copending U.S. patent application 188,556, filed Apr. 29, 1988. In particular, the film was prepared from a 12 micrometer (48 gage) layer of PET film, metallized with aluminum to an optical density of 0.22±0.03. On each side of this film was laminated a sheet of 12 micrometer (48 gage) heat stabilized PET film (from Toyobo), using Adcote TM 506-40 adhesive. One surface of the composite was provided with a layer of the low-melting polyester copolymer described above, for heat-sealing. The susceptor film liner was held in place using the same tape as in Example 1. A cover of the same film material was taped on the top of a cardboard frame which was in turn taped to the top of the filled, lined mold. Thus the two susceptor films were separated by an insulating frame, to avoid overheating. After 75 seconds of heating in the microwave oven of Example 1, a browned french fry was obtained.

We claim:

1. A package suitable for microwave cooking and browning of a finished food item prepared from a formable, brownable food precursor, comprising:

(a) a microwave susceptive mold comprising at least one cavity of a suitable size and shape for the finished food item, said mold having sufficient microwave activity to generate sufficient heat in a microwave oven to brown a brownable food precursor placed adjacent thereto;

(b) a portion of formable, brownable food precursor contained with and conformed to said at least one cavity; and (c) a cover extending over and closing the cavity, said cover being provided with a microwave susceptor layer having sufficient microwave activity to generate sufficient heat in a microwave oven to cook and brown a brownable food precursor placed adjacent thereto.

2. The package of claim 1 wherein the microwave susceptive mold comprises a microwave transparent substrate and a microwave susceptor layer on at least the inside surface of the cavity of the microwave susceptive mold.

3. The package of claim 2 wherein the microwave susceptor layer comprises a layer of film carrying a microwave susceptor material, said film being secured to the surface of the substrate.

4. The package of claim 2 wherein the microwave susceptor material carried on the film comprises a substantially continuous thin layer of metal.

5. The package of claim 2 wherein the microwave susceptor material carried on the film comprises metal flakes.

6. The package of claim 1 wherein the mold comprises a plurality of cavities.

7. The package of claim 6 wherein the plurality of cavities vary in shape, the variations, and the distribution of the variations, corresponding to variations and distribution encountered in a customary portion of a naturally occurring finished food item.

8. The package of claim 1 wherein the food precursor is a potato composition.

9. The package of claim 1 wherein the cover comprises a substantially planar film.

10. A process of microwave cooking and browning of a food item prepared from a formable, brownable food precursor, said process comprising:

(a) preparing the formable, brownable food precursor;

(b) placing the food precursor into a cavity in a mold, said mold being microwave susceptive and having sufficient microwave activity to generate sufficient heat in a microwave oven to cook and brown a brownable food precursor placed adjacent thereto;

(c) conforming the food precursor to the contours of the cavity of the mold;

(d) providing a cover for the mold, said cover having sufficient microwave activity to generate sufficient heat and brown a brownable food precursor placed adjacent thereto; and (e) cooking the food precursor in a microwave oven for a time sufficient to cook the food precursor and to brown its surface.

11. A process of microwave cooking and browning of a food item prepared from a formable, brownable food precursor, said process comprising:

(a) preparing the formable, brownable food precursor;

(b) placing the food precursor into a cavity in a mold, said mold being microwave susceptive and having sufficient microwave activity to generate sufficient heat in a microwave oven to cook and brown a brownable food precursor placed adjacent thereto;

(c) conforming the food precursor to the contours of the cavity of the mold;

(d) providing a cover for the mold, said cover having sufficient microwave activity to generate sufficient heat and brown a brownable food precursor placed adjacent thereto;

(e) cooking the food precursor in a microwave oven for a time sufficient to cook the food precursor and to brown its surface; and (f) interrupting the cooking step prior to said sufficient time, reconforming said food precursor to the cavity of the mold by pressing, and cooking further to complete said sufficient cooking time.

* * * * *